US009462916B2

(12) United States Patent
Adams

(10) Patent No.: US 9,462,916 B2
(45) Date of Patent: Oct. 11, 2016

(54) SHOWER RECEPTOR

(71) Applicant: Kohler Co., Kohler, WI (US)

(72) Inventor: John Kenneth Adams, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 210 days.

(21) Appl. No.: 14/271,681

(22) Filed: May 7, 2014

(65) Prior Publication Data

US 2014/0331403 A1 Nov. 13, 2014

Related U.S. Application Data

(60) Provisional application No. 61/821,545, filed on May 9, 2013.

(51) Int. Cl.
*A47K 3/40* (2006.01)

(52) U.S. Cl.
CPC ..... *A47K 3/40* (2013.01)

(58) Field of Classification Search
CPC ..... A47K 4/30; E03F 5/0407; E03F 5/0408
See application file for complete search history.

(56) References Cited

U.S. PATENT DOCUMENTS

| | | | |
|---|---|---|---|
| 3,457,568 | A | 7/1969 | Amatruda |
| RE31,561 | E | 4/1984 | Thompson |
| D333,342 | S | 2/1993 | Newhard |
| 5,341,523 | A | 8/1994 | Barnes |
| D351,019 | S | 9/1994 | Moore et al. |
| 5,458,769 | A | 10/1995 | Johannessen |
| D404,476 | S | 1/1999 | Formgren |
| 5,894,611 | A | 4/1999 | Toro |
| 6,817,043 | B2 | 11/2004 | Zars |
| D531,289 | S | 10/2006 | Pipe |
| D532,877 | S | 11/2006 | Hisey |
| D541,913 | S | 5/2007 | Piatt |
| D565,157 | S | 3/2008 | Bates |
| D596,721 | S | 7/2009 | Hisey |
| D596,722 | S | 7/2009 | Hisey |
| D609,316 | S | 2/2010 | Hisey |

(Continued)

FOREIGN PATENT DOCUMENTS

| | | | |
|---|---|---|---|
| CN | 1831255 | A | 9/2006 |
| CN | 201701121 | U | 1/2011 |

(Continued)

OTHER PUBLICATIONS

Kohler Fixtures 2014 Price Book, Mar. 15, 2014, pp. 146-152 and 160-163.

(Continued)

*Primary Examiner* — Janie Loeppke
(74) *Attorney, Agent, or Firm* — Foley & Lardner LLP

(57) ABSTRACT

A shower base for a shower assembly comprising a floor, a drain cavity, and a transition. The floor includes an end and at least one side. The drain cavity is disposed at the end, and the drain cavity is recessed downwardly relative to the floor to capture water therein. The transition connects the end of the floor to a portion of the drain cavity. The transition comprises a first section having a compound radius that varies in size along the first section, wherein the first section extends outwardly from a vertex to the at least one side of the floor, and where the first section is directly connected to the end of the floor.

21 Claims, 13 Drawing Sheets

(56) References Cited

U.S. PATENT DOCUMENTS

| | | | | |
|---|---|---|---|---|
| D611,129 | S | 3/2010 | Hisey | |
| D612,027 | S | 3/2010 | Hisey | |
| D613,839 | S | 4/2010 | Hisey | |
| 7,739,757 | B2 | 6/2010 | Witt | |
| D672,850 | S | 12/2012 | Adams | |
| D682,999 | S | 5/2013 | Adams | |
| 2003/0141231 | A1 | 7/2003 | Rattenbury et al. | |
| 2005/0029270 | A1 | 2/2005 | Marshall | |
| 2012/0079652 | A1 | 4/2012 | Lemire et al. | |
| 2014/0201902 | A1* | 7/2014 | Stimpson | E03F 5/0407 4/613 |

FOREIGN PATENT DOCUMENTS

| | | | |
|---|---|---|---|
| DE | 20006667 | | 6/2000 |
| DE | 202006009037 | | 8/2006 |
| DE | 202009004000 | | 7/2009 |
| DE | 202011000278 | | 6/2011 |
| FR | 2771431 | A1 | 5/1999 |
| WO | WO 2008/088457 | | 7/2008 |

OTHER PUBLICATIONS

European Search Report dated Sep. 11, 2014, 6 pages.

* cited by examiner

SHOWER RECEPTOR

CROSS-REFERENCE TO RELATED PATENT APPLICATIONS

This application claims the benefit of and priority to U.S. Provisional Patent Application No. 61/821,545, which was filed on May 9, 2013. The foregoing U.S. provisional application is incorporated by reference herein in its entirety.

BACKGROUND

This application relates generally to the field of bases or receptors for baths (e.g., showers, bath tubs, etc.) and sinks. More specifically, this application relates to shower bases having improved transitions between the floor and drain pocket.

When shower receptors are made from cast iron or are enameled, the high temperatures associated with either process (e.g., casting, enameling) may sometimes distort the floors of the receptors, creating one or more low pockets or low spots. In other words, during casting and/or enameling of the receptor, certain portions, such as the transition between the floor and drain pocket and the floor near the transition, have a tendency to sag below the other portions of the floor, creating an uneven floor having low pockets or spots. The low pockets may collect water and create draining issues, since the water is unable to flow properly to the drain. Additionally, the uneven floor is not aesthetically pleasing to most customers and can be highly visible when the low spot is near the transition.

SUMMARY

One embodiment of this application relates to a shower base for a shower assembly comprising a floor, a drain cavity, and a transition. The floor includes an end and at least one side. The drain cavity is disposed at the end, and the drain cavity is recessed downwardly relative to the floor to capture water therein. The transition connects the end of the floor to a portion of the drain cavity. The transition comprises a first section having a compound radius that varies in size along the first section. The first section extends outwardly from a vertex to the at least one side of the floor, and the first section is directly connected to the end of the floor.

Another embodiment relates to a shower assembly comprising a shower base and a drain cover. The shower base comprises a floor, a drain cavity, and a transition. The drain cavity is disposed at a first side of the floor and recessed downwardly relative to the floor to capture water therein. The transition connects the first side of the floor to a first side of the drain cavity. The transition includes a first section having a compound radius and extends outwardly from a vertex to a second side of the floor. The drain cover is configured to removably engage the shower base to conceal the drain cavity, and the drain cover includes a side that is proximate to the transition. A gap is provided between the side of the drain cover and the first section of the transition, and the gap has an appearance of having a constant size along a length of the first section.

Yet another embodiment relates to a shower assembly comprising a floor, a downwardly recessed drain cavity, a first transition, and a second transition. The floor includes a generally conical section. The drain cavity is disposed at a first side of the section of the floor. The first transition interconnects a first portion of the drain cavity and a first portion of the first side of the section of the floor. The first transition has a compound radius and extends outwardly from a vertex to a second side of the floor. The second transition interconnects a second portion of the drain cavity and a second portion of the first side of the section of the floor. The second transition has a compound radius and extends outwardly from the vertex to a third side of the floor. The first transition has an increasing size moving from the vertex to the second side of the floor and the second transition has an increasing size moving from the vertex to the third side of the floor.

BRIEF DESCRIPTION OF THE DRAWINGS

FIGS. 14A-14G are various cross-sectional views taken along the various front to back cutting lines shown in FIG. 14.

FIGS. 15A-15D are various cross-sectional views taken along the various side to side cutting lines shown in FIG. 15.

DETAILED DESCRIPTION

Referring generally to the Figures, disclosed herein are shower bases or receptors including floors connected to drain cavities through transitions having shapes that are configured to improve the aesthetics of and prevent pooling of water on the shower bases (e.g., the floors thereof). The shapes of the transitions of the shower bases, as disclosed herein, may also increase the strength of the shower base. The shower bases, as discussed herein, may include transitions having a variable sized section, a constant sized section, or any combination thereof. The transitions may include one or more than one section having a compound radius (e.g., a section having a variable radius that changes in size along a length of the section). For example, the transitions may include at least one conical section having a compound radius that extends adjacent to or abuts another section, such as a curved section having a constant radius. Also, for example, the transitions may include a pair of sections that extend in opposite directions away from a vertex, where each section is configured having a compound radius. Each compound radius section may have, for example, a conical (e.g., semi-conical) shape. Optionally, a curved section may be provided below the two conical sections, such as directly connected to a bottom edge of each conical section.

The shower bases, as disclosed herein, may advantageously increase the strength of the shower base to reduce its tendency to distort or deform, such as during forming, post treatment (e.g., enameling), or transporting the shower base. The increased strength reduces the amount of sag, such as in the floor, which eliminates or greatly reduces the likelihood that low pockets will form along the floor and/or the transition. Thus, the shower bases, as disclosed herein, may prevent pooling of water on the floor and, in effect, improve the flow of water across the floor to the drain cavity. Additionally, the shower bases, as disclosed herein, may also improve the aesthetics of the system. For example, the shower base may have a uniform sized gap between the transition and a cover engaging the drain cavity of the shower base, such as where the gap is measured from the cover to a line along the transition.

Figure 1:
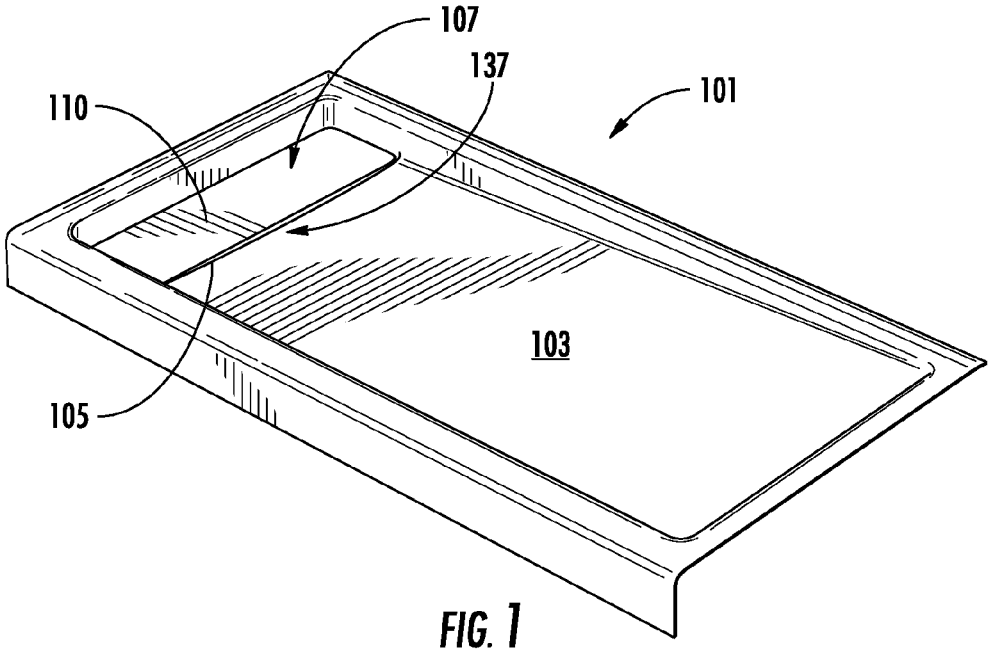
FIG. 1 is a perspective view of a receptor and cover.
Figure 2:
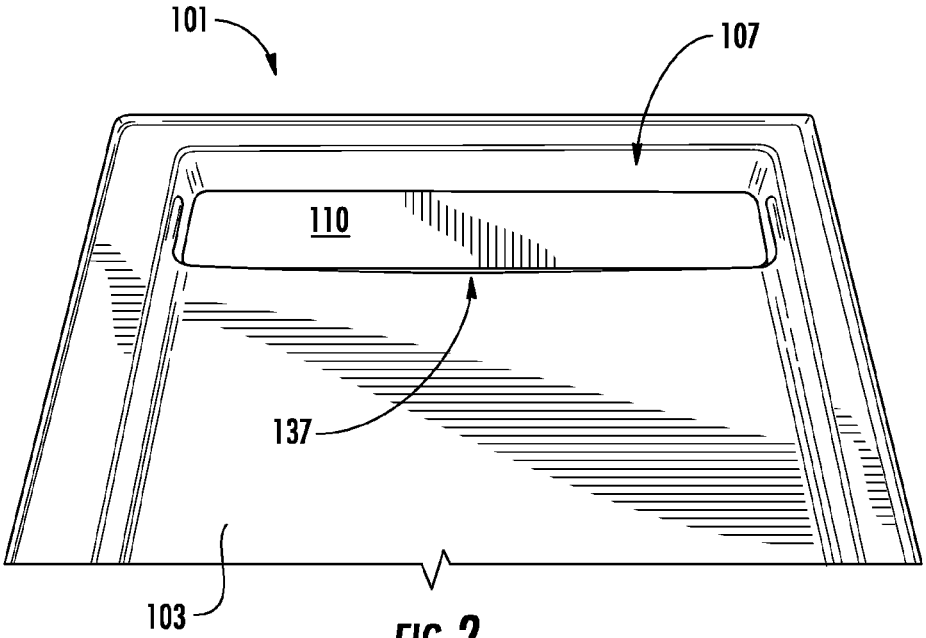
FIG. 2 is another perspective view of the receptor and cover of FIG. 1.

FIGS. 1 and 2 illustrate an example of a shower receptor 101 having an uneven floor 103 with a low pocket 137 in the floor 103 and near a transition 105 provided between the floor 103 and a drain pocket 107. Accordingly, upon assembly of a cover 110 into the drain pocket 107, the low pocket 137 is readily apparent, since the transition 105 and cover 110 have non-complementary adjacent profiles. Additionally, the low pocket 137 can collect water from the shower, leading to draining issues, since the water may not flow properly along the floor 103 to the drain pocket 107.

Figure 3:
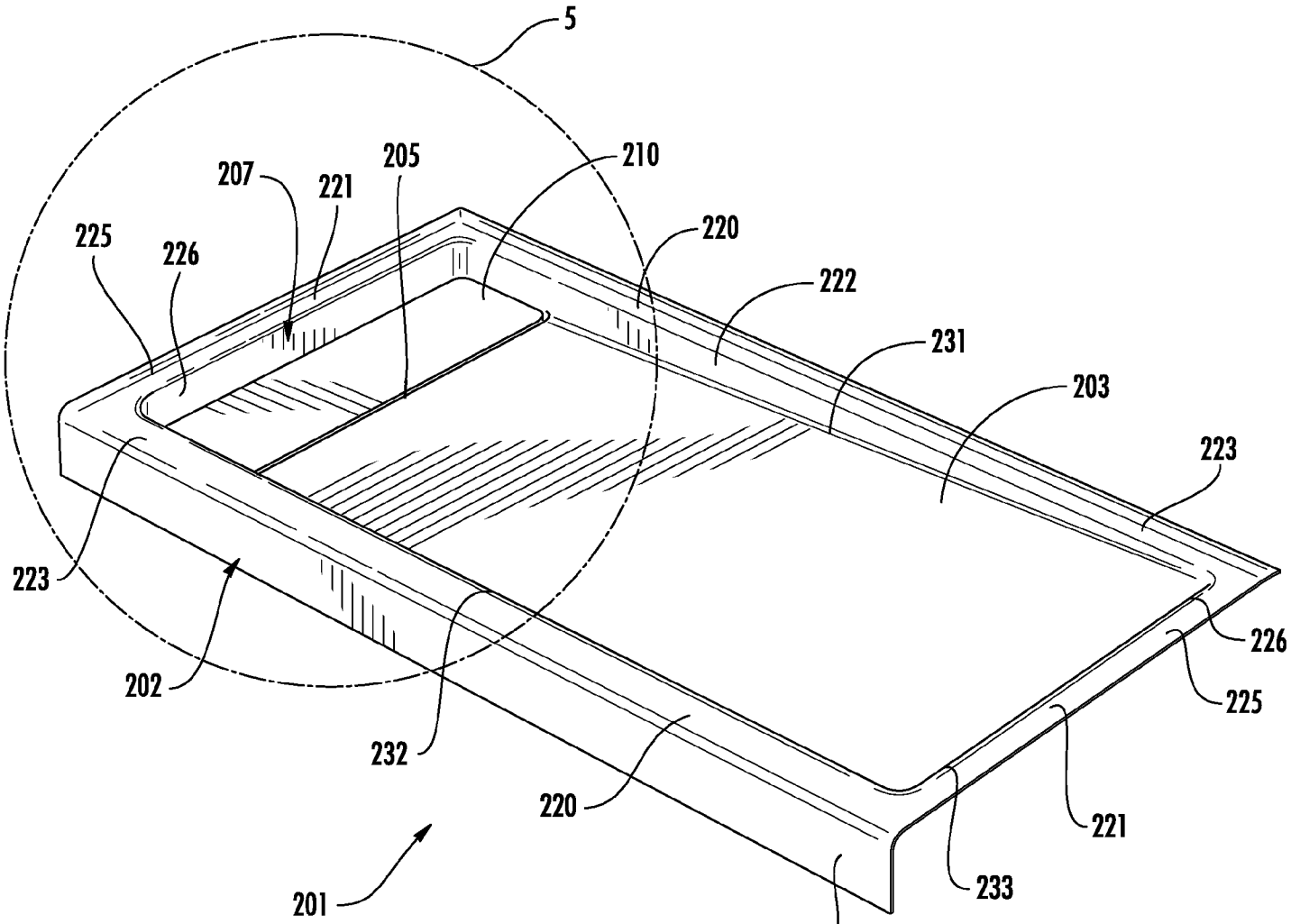
FIG. 3 is a perspective view of an exemplary embodiment of a shower assembly including a shower base or receptor and a cover.
Figure 4:
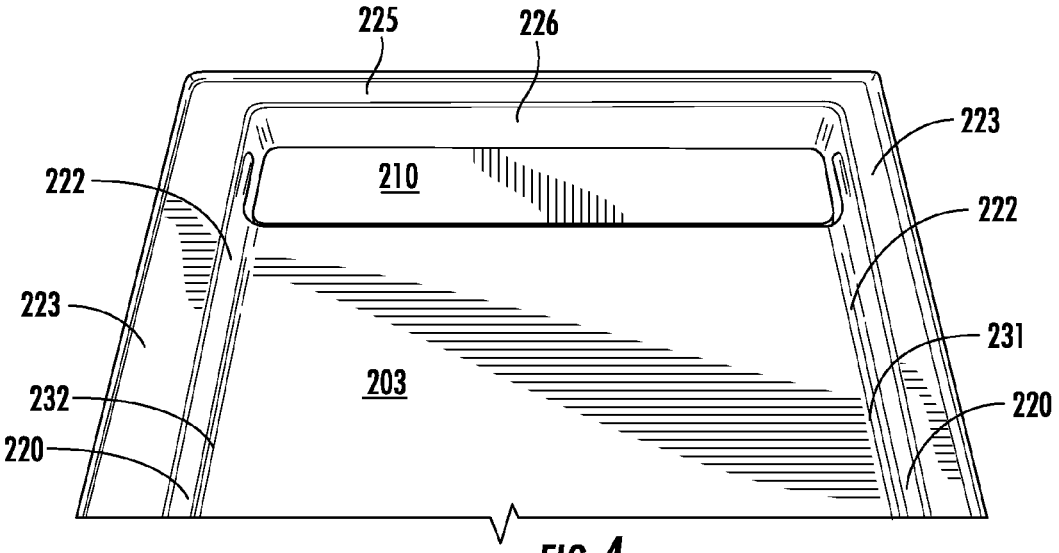
FIG. 4 is another perspective view of the shower assembly of FIG. 3.
Figure 5:
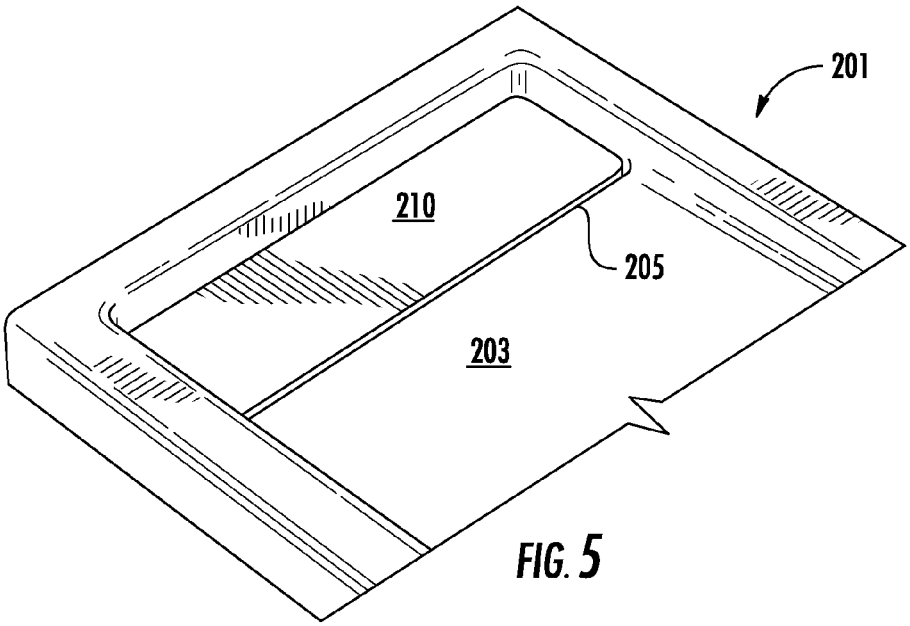
FIG. 5 is another perspective view of the shower assembly of FIG. 3.

FIGS. 3-5 illustrate an example of a shower assembly, which includes a shower base 201 (e.g., a shower receptor, receptor, base, etc.). The shower assembly, including the shower base 201, is configured for use in a shower system (not shown), such as, for example, a shower stall that also includes one or more walls and/or doors. For example, the shower base assembly may include a shower base 201 installed at the bottom of a shower stall, such that the shower base 201 provides the floor of the shower assembly. It is noted that although the bases that are disclosed herein are generally configured for use with shower assemblies, the bases may be used with other fixtures, such as bath tubs or sinks.

The shower assembly may also include a cover. As shown in FIGS. 3-5, the shower assembly also includes a cover 210 that is configured to removably (e.g., detachably) engage a portion of the shower base 201. For example, the cover 210 may be configured to removably engage a drain cavity 207 of the shower base 201 to conceal a drain opening 277 (e.g., drain hole) provided in the drain cavity 207, while still allowing water to reach the drain hole for proper drainage.

Figure 6:
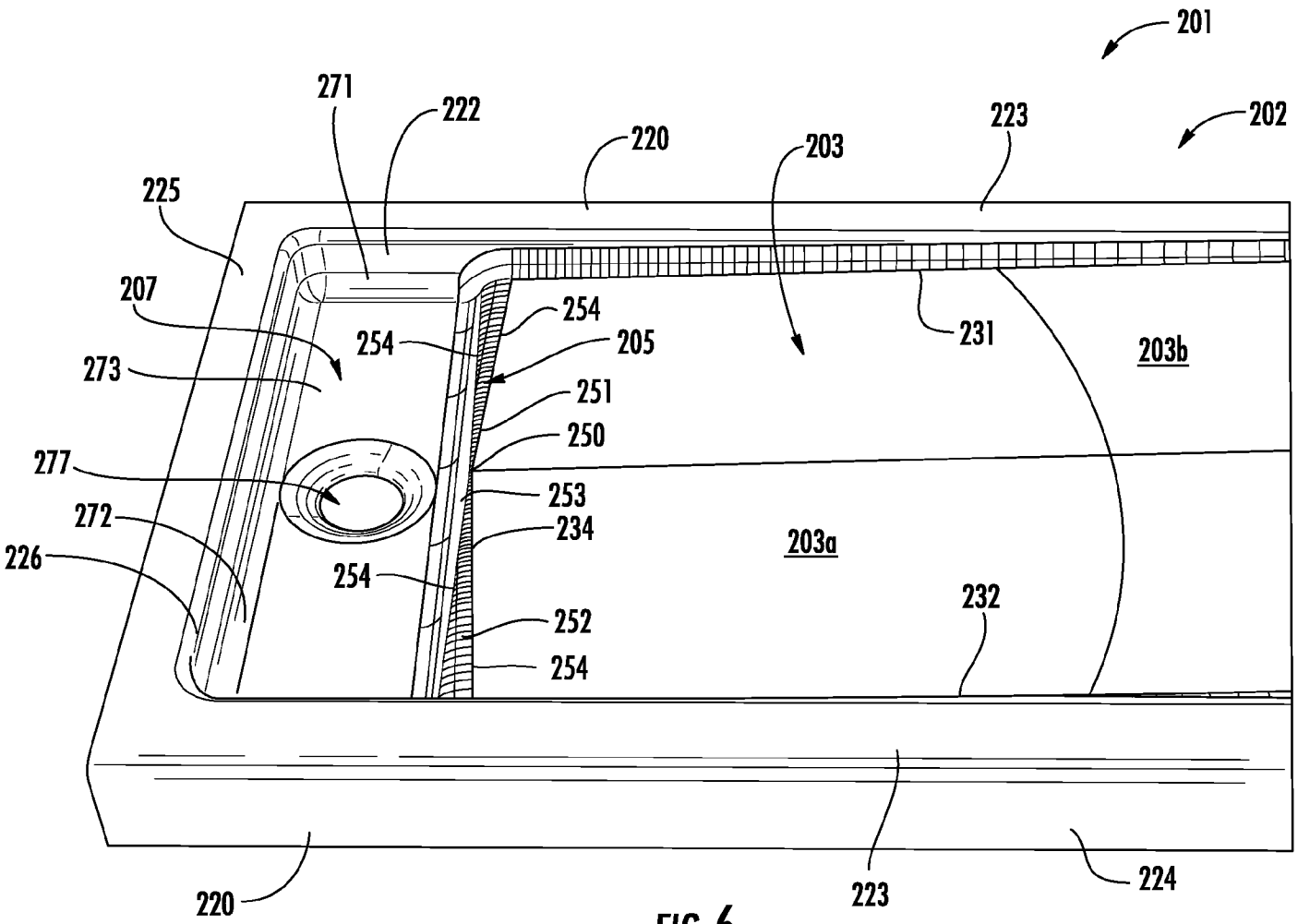
FIG. 6 is another perspective view of the shower base of FIG. 3 with surface shading provided to illustrate the geometry of the shower base.
Figure 7:
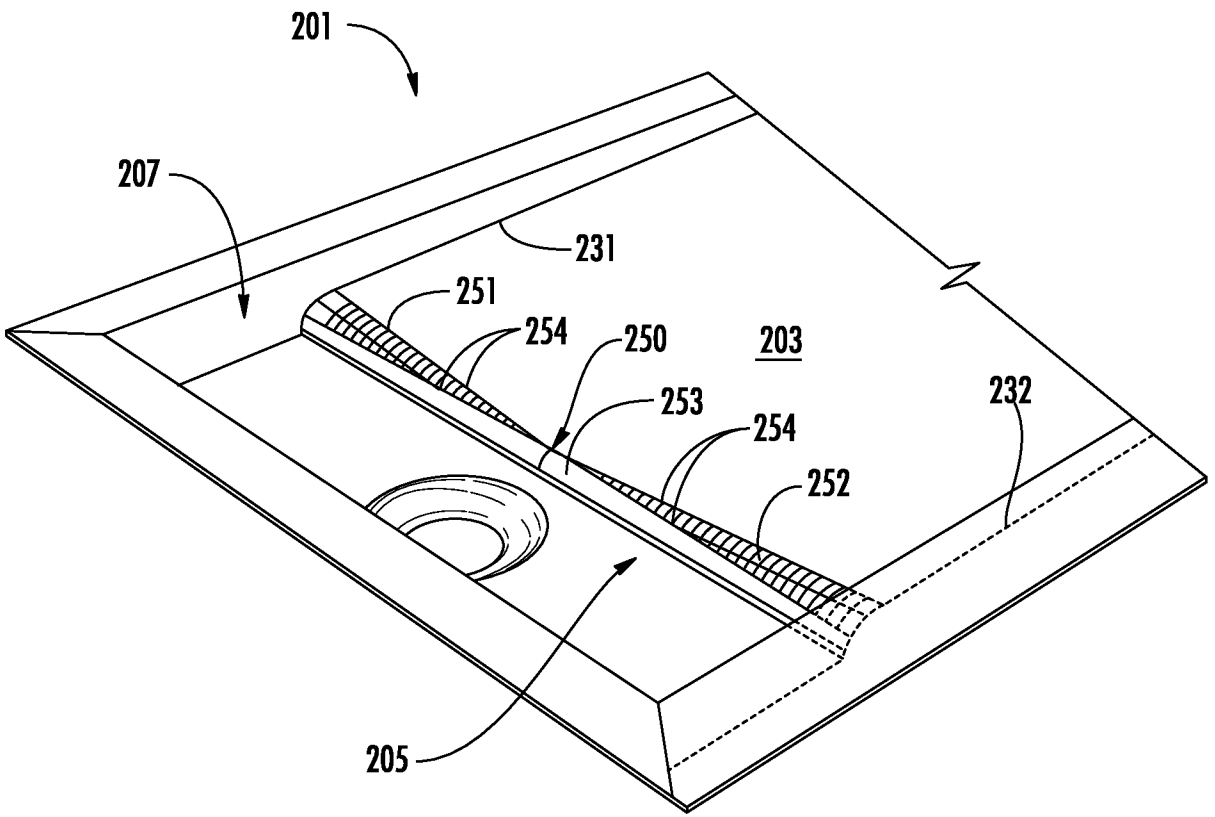
FIG. 7 is another perspective view of the shower base of FIG. 3 with surface shading provided to illustrate the geometry of the shower base.

FIGS. 3-7 illustrate an exemplary embodiment of a shower base 201. FIGS. 3-5 illustrate the cover 210 engaging the drain cavity 207 of the shower base 201. FIGS. 6 and 7 illustrate the shower base 201 without any cover. As shown, the shower base 201 includes a frame 202, a floor 203, a drain cavity 207 (e.g., drain pocket), and a transition 205 extending between the floor 203 and the drain cavity 207. According to an exemplary embodiment, the frame 202 has a generally rectangular shape and may surround the floor 203, the transition 205, and the drain cavity 207. According to other exemplary embodiments, the frame has other suitable shapes (e.g., oval, elliptical, square, etc.). The frame 202 may be elevated above the floor 203 to retain or capture water within the frame 202 of the base 201. It is noted that the shower base 201 may be integrally formed as one member, or each element of the shower base 201 may be formed separately and then coupled together. In other words, the frame 202, the floor 203, the drain cavity 207, and the transition 205 may be integrally formed, such as through casting or another suitable process, may be formed separately and then coupled together, or may be made through a combination of integrally formed and separately formed members.

The frame 202 of the shower base 201 may include a wall or plurality of walls, which may form one or more than one side and/or one or more than one end. As shown in FIG. 3, the frame 202 includes a pair of opposing sides 220 and a pair of opposing ends 221 interconnected (e.g., coupled) together. Each side 220 may include a side wall 222 and a top wall 223 extending from an upper portion of the side wall. For example, each side wall 222 may be a generally vertical wall and may be interconnected with the floor 203, and each top wall 223 may be a generally horizontal wall. Each side 220 may also include a second side wall 224, such that the side 220 includes an inner side wall 222 spaced apart from an outer side wall 224 by the top wall 223. In other words, each side 220 may be configured as a channel, which may have a generally U-shape or C-shape.

Each end 221 may include a top wall 225 and an end wall 226, where the top wall 225 is interconnected with the adjacent top walls 223 of the sides 220 and where the end wall 226 extends away from the top wall of the end 221. For example, the end wall 226 of the end 221 may be configured perpendicular to the top wall 225 and may be interconnected with the floor 203. Each end 221 may include a second end wall (not shown) that is connected to the top wall 225 and spaced apart from the end wall 226, such as to form a channel.

The floor 203 of the shower base 201 may be connected with the frame 202. As shown, the floor 203 includes a first edge 231, a second edge 232, a third edge 233, and a fourth edge 234. The first and second edges 231, 232 of the floor 203 are connected to the sides 220 of the frame 202. For example, the first and second edges 231, 232 of the floor 203 may be interconnected with the inner side walls 222 of the sides 220. The third edge 233 of the floor 203 is connected to an end 221 of the frame 202. For example, the third edge 233 may be interconnected with an end wall 226.

As shown best in FIGS. 3 and 6, the floor 203 is configured at an angle relative to the top walls 223, which may be configured generally horizontal. For example, the third edge 233 of the floor 203 may be elevated relative to the fourth edge 234, such that water flows from the third edge 233 toward the fourth edge 234. In other words, the floor 203 is inclined so that water runs toward the drain. Thus, the floor 203 may be configured having a downward slope from the end opposite the drain cavity 207 to the end adjacent the drain cavity 207 to facilitate effective draining of water along the floor 203. According to an exemplary embodiment, the floor 203 is configured generally flat (e.g., planar, smooth, etc.). However, if the floor 203 is formed (e.g., designed) perfectly flat, then during casting or enameling of the shower base 201, the high temperatures may induce sagging in certain portions of the floor relative to other portions, which may form low spots that may collect water or impede the flow of water.

Figure 12:
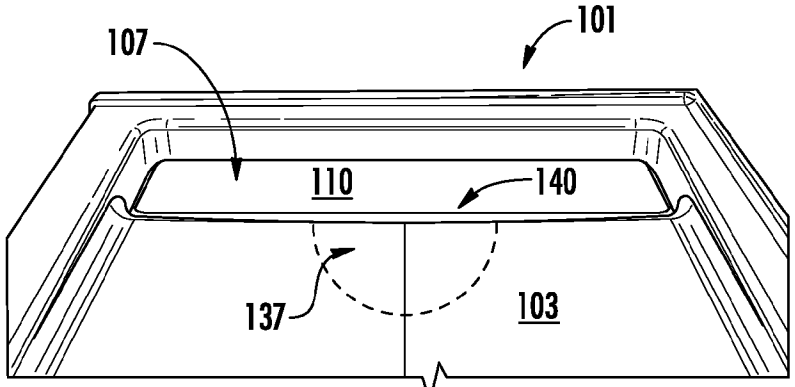
Figure 13:
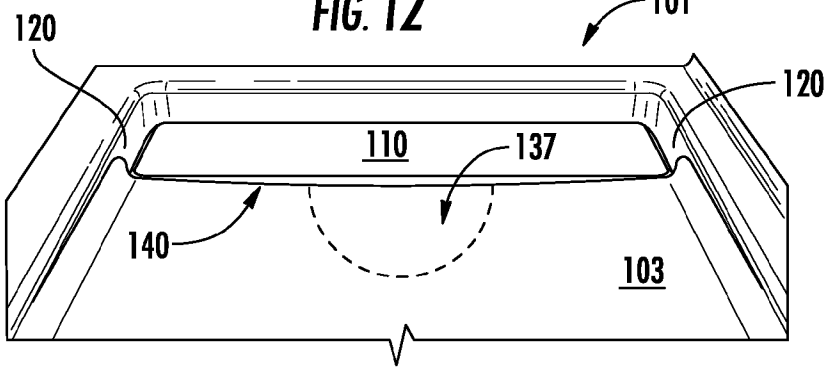

According to another exemplary embodiment, the floor 203 may be configured having one or more than one portion that is not flat. As shown in FIG. 6, the floor 203 includes a forward section 203*a* that has a generally conical shape. For example, the conical forward section 203*a* may have a center that is approximately concentric with the center of the drain opening 277, such that the forward section 203*a* slopes generally toward the drain opening from all sides to facilitate draining of water along the section. The floor 203 may also include a rearward section 203*b*, which may be flat or not flat. If the shower base 201 was provided without the transition 205, then the conical forward section 203*a* would have a curved fourth edge 234 having a non-complementary profile relative to the cover 210. In other words, without the transition 205, the forward edge (e.g., the fourth edge 234) of the forward section 203*a* would have a curved appearance, which would appear as having a larger gap relative to the cover 110 at the center of the floor 203 (e.g., from a side to side perspective) than the gap at the sides of the floor 203, such as shown in FIGS. 12 and 13. The transition 205 is configured to correct the non-complementary appearance between the floor 203 and the cover 210, such that the shower base 201 and the cover 210 have a complementary appearance. For example, the gap between a portion (e.g., a front side) of the drain cover and all or part of the transition (e.g., all or part of the section having the compound radius) may have a constant size to provide a complementary appearance.

As shown in FIG. 6, the drain cavity 207 of the shower base 201 is configured to capture or collect water that runs off from the floor 203 and drain the collected water from the shower base 201. The drain cavity 207 may be recessed into the shower base 201, such that the drain cavity 207 is sunken relative to the floor 203 to allow the water running off the floor to enter the drain cavity 207. The drain cavity 207 may include a wall or plurality of walls forming the recessed pocket. For example, the drain cavity 207 may include side walls 271 that are connected to the side walls 222 of the sides 220, and may include an end wall 272 that is connected to the end wall 226 of the end 221, as shown in FIG. 7. Also, for example, the drain cavity 207 may include a base 273, which may include a drain configured to drain the water from the shower base 201. The drain may be configured as an opening 277 (e.g., a hole, an outlet, a passage, etc.). As shown, the drain cavity 207 is connected to the transition 205. For example, the base 273 of the drain cavity 207 may be connected to the transition 205, such as a section thereof. Alternatively, the drain cavity 207 may include a wall (e.g., an end wall opposite the end wall 272) that is connected to the transition 205, such as a section thereof.

The transition 205 of the shower base 201 is provided between the floor 203 and the drain cavity 207, and is configured to facilitate the movement of water from the floor 203 to the drain cavity 207. Thus, a portion of the transition 205 may be directly connected to a portion of the floor 203 (e.g., an end thereof), and another portion of the transition 205 may be directly connected to a portion of the drain cavity 207. As shown, the transition 205 extends between the inner side walls 222 of the sides 220.

The transition may be configured having one or more than one section (e.g., portion) with a compound radius (e.g., a section having a radius that varies in size along a length of the transition). For example, the radius of the section having the compound radius may change (e.g., increase, decrease) having a linear progression along its length (i.e., where the varying radius changes linearly along its length). Alternatively, the radius of the section having the compound radius may change in a non-linear manner along its length.

According to an exemplary embodiment, the transition includes at least one section having a compound radius and at least one section having a constant radius (i.e., where the size of the radius remains constant along its length). As shown in FIGS. 6 and 7, the transition 205 includes a first section 251 having a first compound radius and a second section 252 having a second compound radius, where the first and second sections 251, 252 extend from a vertex 250 (e.g., focal point, focal location, etc.) in opposite directions. The transition 205 may also include a third section 253 having a constant radius. The first and second sections may extend from the vertex with an increasing size (e.g., radius, diameter, etc.) moving toward one of the sides 220 of the shower base 201. Thus, the third section 253 may have a constant radius while the first and second sections have variable radii. The first and/or second sections may be in direct contact with the third section. Thus, each section having a compound radius may share a coincident edge with the section having a constant radius. The first and second sections having the variable radii may be configured symmetrically opposite, such as relative to the vertex or focal location, or may be configured to not be symmetric.

The transition 205 having both a constant radius section and at least one compound (or variable) radius section may advantageously provide an improved appearance with the cover installed in the drain cavity of the shower base. Additionally, the transition 205 may also be configured having an increased strength to try to eliminate the low pockets or greatly reduce the amount of sag along the floor, and in particular, along the end of the floor that is adjacent to the transition. By reducing the sag, the transition 205 eliminates low pockets and, therefore, prevents water from pooling.

FIGS. 6 and 7 illustrate the shower base 201 using shading to help show the geometric configuration (e.g., shape) of the floor 203, the transition 205, and the drain cavity 207. As shown, the transition 205 includes first and second sections 251, 252 that are in direct connection with the fourth edge 234 of the floor 203, and further includes a third section 253 that is in direct connection with the first section 251, the second section 252, and the drain cavity 207. For example, each of the first and second sections 251, 252 connecting the transition 205 to the fourth edge 234 of the floor 203 may be in the form of a variable radius section, which extends away from a focus or vertex 250. The vertex 250 may be provided at an approximate center (e.g., mid-point, mid-plane, etc.) of the shower base 201, which may also be the approximate center of the floor 203. Alternatively, the vertex 250 may be provided at a location that is offset from the center of the floor 203 and/or the shower base 201, such as to either side of the center by a predetermined distance. For example, the vertex 250 may be aligned with the center of the drain opening 277, where both the center of the drain opening 277 and the vertex 250 may be located at an offset distance from the center or mid-plane of the floor 203.

Each of the first and second sections 251, 252 may be configured having a compound or variable radius, which may, for example, increase in size (e.g., have a larger radius when) moving from the vertex 250 to the respective side 220 of the shower base 201. According to an exemplary embodiment, each of the first and second sections 251, 252 has a linear conical shape with linear edges 254 that are directly connected to the fourth edge 234 and/or the third section 253. Thus, the first section 251 may have one edge 254 that is collinear (e.g., coincident) with a portion of an edge 234 of the floor 203, and the second section 252 may have one edge 254 that is collinear with another portion of an edge 234 of the floor 203. The first and second sections 251, 252 may be configured having a linearly increasing size. For example, each edge 254 of the first section 251 and/or the second section 252 may extend at a pitch angle between 0-10° (zero and ten degrees), and more preferably may extend at a pitch angle between 0-4° (zero and four degrees). Even more preferably, the edge 254 of the first section 251 and/or the second section 252 may extend at a pitch angle of about 2° (two degrees), such as two degrees plus or minus one half of one degree. The pitch angle may be, for example, the angle relative to the edge for a constant size (e.g., radius) section, which may be a horizontal line.

According to another exemplary embodiment, each of the first and second sections 251, 252 has a curved conical shape with curved edges that are directly connected to the fourth edge 234 and/or the third section 253. For example, the first section 251 and/or the second section 252 may be configured having a parabolic shape, an arcuate shape, or any other suitable curved shape. Thus, the first and second sections 251, 252 may be configured having a non-linear increasing size.

The third section 253 of the transition 205 may be configured as having a constant radius, which may, for example, extend between the two opposing sides 220 of the shower base 201. As shown in FIGS. 6 and 7, the third section 253 extends directly from the first and second sections 251, 252. For example, the third section 253 may be disposed below the first and second sections 251, 252, such that the upper edge of the third section 253 is adjacent to the lower edges of the first and second sections 251, 252. Also, for example, the third section 253 may be disposed below the first and second sections 251, 252, such that the upper edge of the third section 253 is collinear (e.g., coincident) with, and/or the lower edges of the first and second sections 251, 252. In other words, the third section 253 may share a common edge with the first section 251 and/or the second section 252. According to an exemplary embodiment, the entire third section 253 has a common or constant radius. For example, the third section 253 may have a radius less than 50.8 mm (2 inches), and more preferably may have a radius less than 25.4 mm (1 inch). Even more preferably, the radius of the third section 253 may be about 12.7 mm (0.5 inch), such as between 6.35 mm (0.25 inch) and 19.05 mm (0.75 inch).

Figure 8:
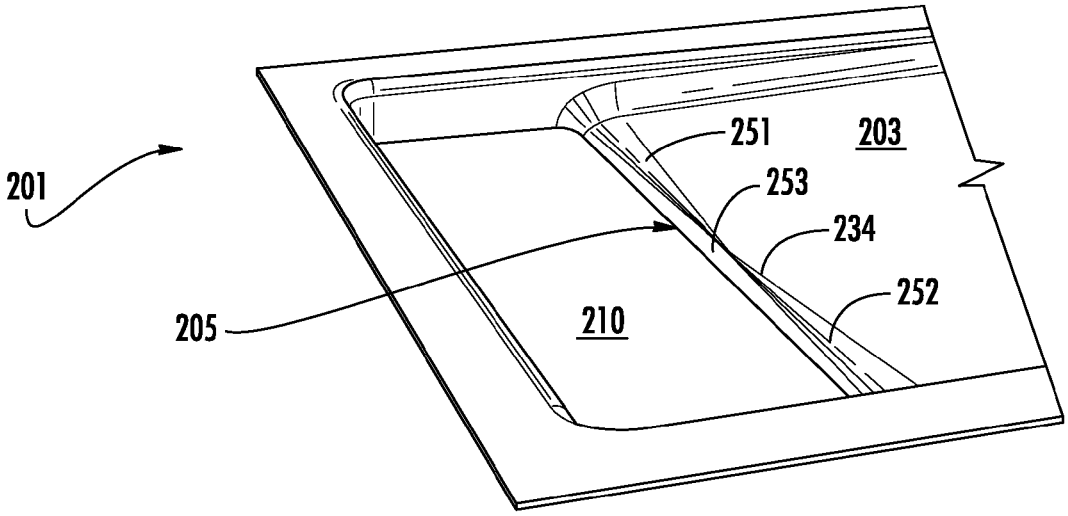
FIGS. 8-13 are various perspective views comparing the shower base of FIG. 3 with the shower base of FIG. 1.
Figure 9:
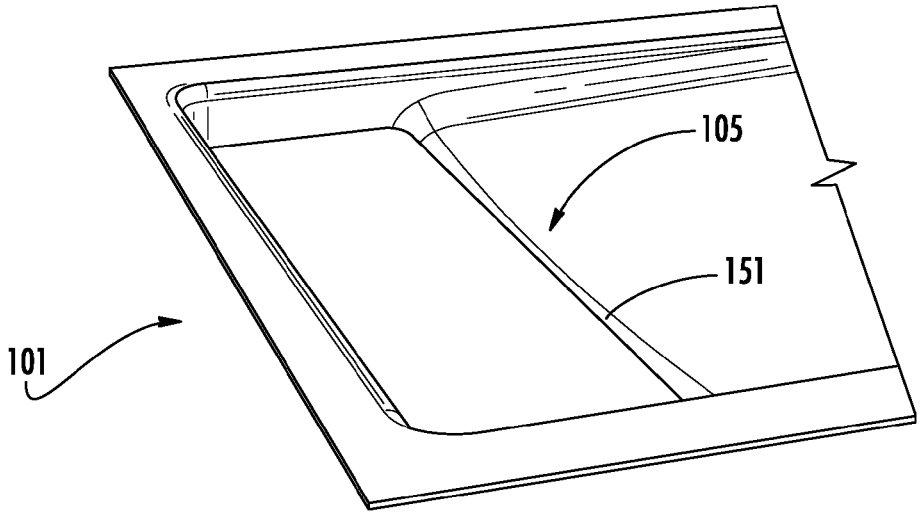
Figure 10:
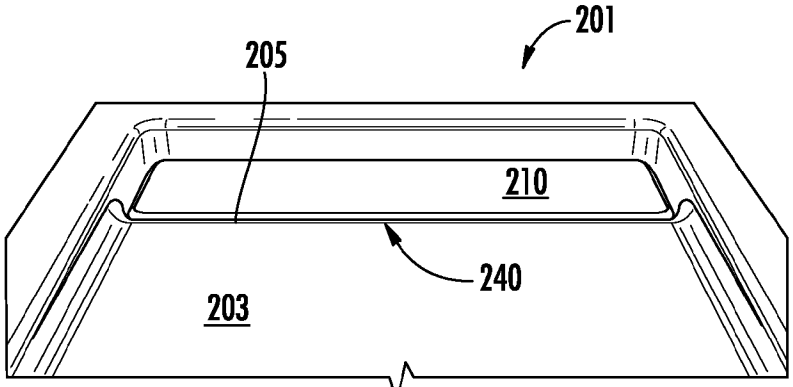
Figure 11:
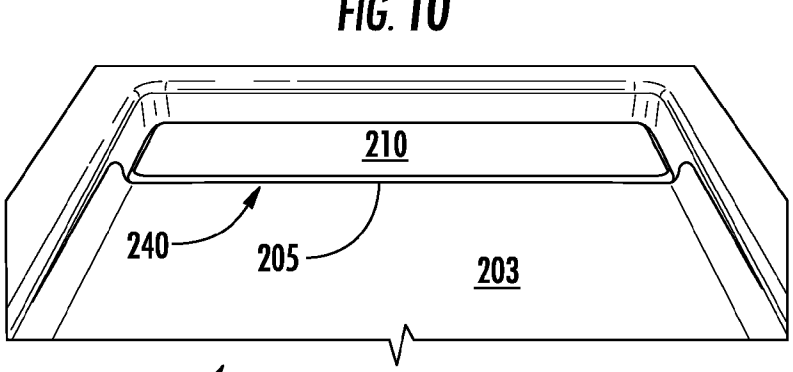

FIGS. 8-13 compare two examples of shower bases having covers provided in the drain cavity of each shower base. FIGS. 8, 10, and 11 illustrate a shower base 201 including a transition 205 having two conical (e.g., semi-conical) sections 251, 252 extending from the fourth edge 234 of the floor 203 and a curved section 253 extending from a bottom edge of the two conical sections 251, 252. FIGS. 8 and 10 illustrate the shower base 201 with surface shading to better show the geometry of the transition 205 and the visual relationship (e.g., the gap) between the shower base 201 and the cover 210, whereas FIG. 11 does not have surface shading. Each of the conical sections 251, 252 have a compound radius (e.g., a variable radius) that extends from the vertex 250 out to the respective side 220. The curved section 253 may have a constant radius extending between the sides 220. FIGS. 9, 12, and 13 illustrate a shower base 101 including a transition 105 having only a single curved section 151 that extends from the forward edge of the floor 103 to the drain pocket 107, and extends between the side walls 120. FIG. 9 illustrates the shower base 101 and cover 110 with surface shading, whereas FIGS. 12 and 13 do not have surface shading.

As shown best in FIGS. 12 and 13, the shower base 101 has a low pocket 137 (illustrated by the dashed lines) formed in the conical portion of the floor 103, such as during manufacture of the base or another post manufacture process. The low pocket 137 provides a place for water to collect and, therefore, to impede proper draining of the water from the floor 103 to the drain pocket 107. Further, when the shower base 101 and the cover 110 are viewed by a person standing on the shower base 101, there is a gap 140 between the cover 110 and the shower base 101 (e.g., the forward edge of the floor 103 and/or the transition 105) that has a size (e.g., width, thickness, etc.) that varies depending on the location along the width of the shower base 101. In other words, the floor 103 of the shower base 101 has an appearance of dipping in the middle relative to its sides due to the pocket 137. As shown, the size of the gap 140 is smallest closest to the side walls 122 and is largest near the center of the shower base 101. Thus, the low pocket 137 causes the size of the gap 140 between the cover 110 and the shower base 101 to have a different size along the length of the transition 105.

As shown best in FIGS. 10 and 11, the floor 203 of the shower base 201 is configured to not have a low pocket in the conical portion, or if such a low pocket forms, it is small enough not to impede the flow of water across the floor 203. Further, the transition 205 is configured to provide an improved appearance to a person standing on the shower base 201 by providing a gap 240 between the cover 210 and the shower base 201 that has a generally constant size along the length of the transition 205 and along the length of the gap 240. Thus, the gap between the drain cavity 207 and the first and second sections 251, 252 may have a constant size along a length of the sections and/or an appearance of having a constant size along a length of the sections.

Figure 14:
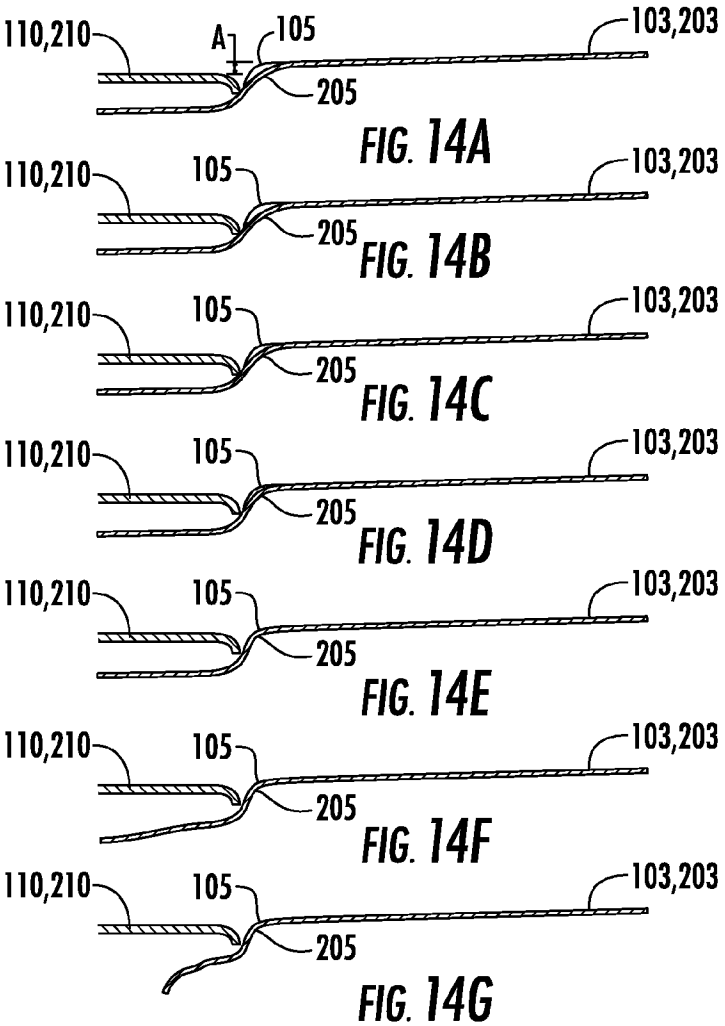
FIG. 14 is a perspective view of the shower bases of FIGS. 1 and 3 overlaying one another.
Figure 14:
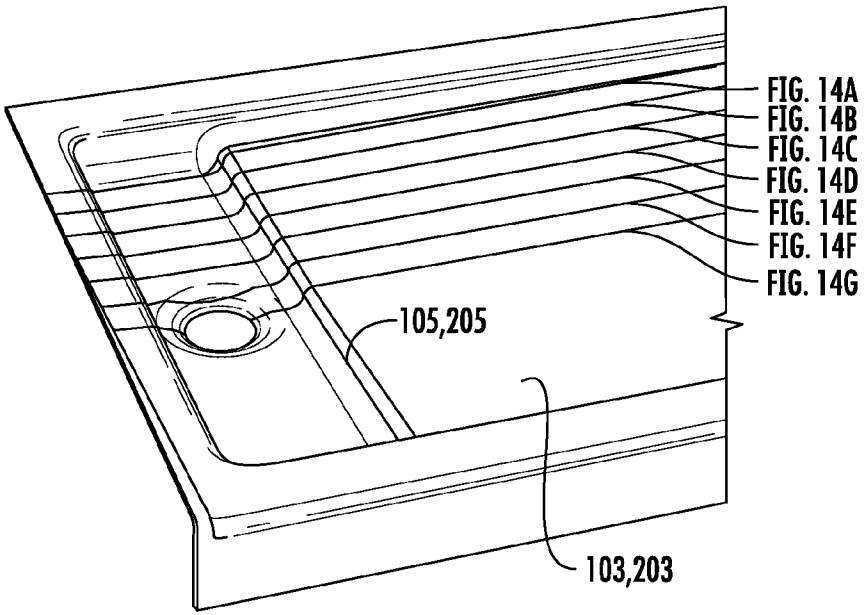
Figure 15:
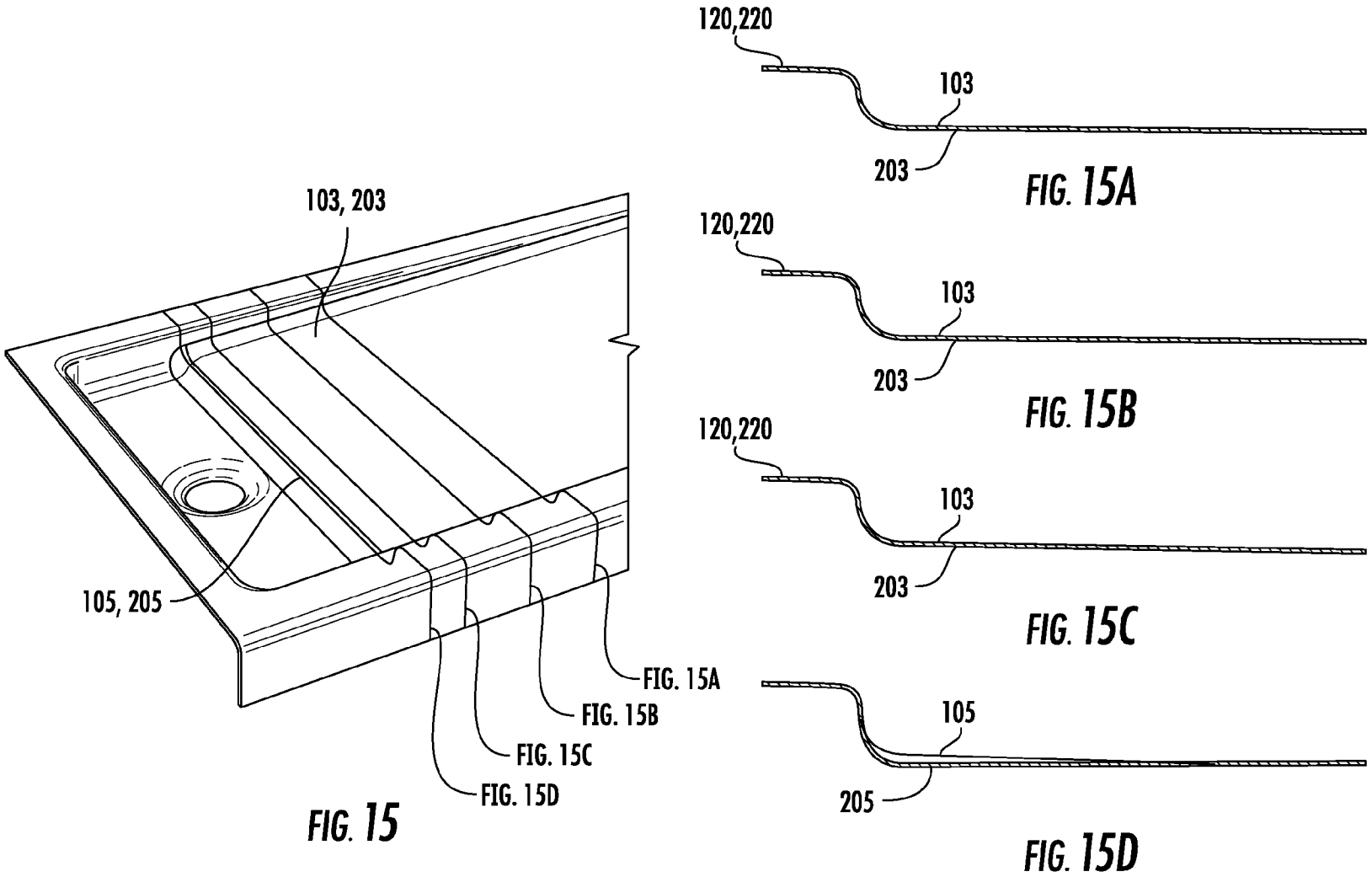
FIG. 15 is another perspective view of the receptors of FIGS. 1 and 3 overlaying one another.

FIGS. 14-15D also compare the shower base 201 to the shower base 101 by cutting a plurality of sections both from side to side and front to back. FIGS. 14 and 15 have both the shower base 101 and the shower base 201 overlaid on top of one another for comparison purposes. FIGS. 14-14G illustrate the sections cut from the lines extending front to back, and FIGS. 15-15D illustrate the sections cut from the lines extending side to side. FIG. 14A illustrates a section cut that is closest to the side wall of the shower base with each successive section (e.g., 14B, 14C, etc.) being cut farther inward relative to the previous section, with FIG. 14G illustrating a section cut at the approximate mid-point or mid-plane of the shower base 201, which according to an example of the base, corresponds to the vertex location.

As shown in FIGS. 14A-14G, the difference between the height of the floor 103, 203 and the height of the cover 110, 210 (which is not shown in FIG. 14, but is shown in the sections for reference) changes (e.g., decreases) moving from the side wall toward the mid-point or mid-plane of the shower base. As shown, the transition 105 of the shower base 101 is configured having different heights at the various sections, which reduce relative to the cover 110 moving from the section of FIG. 14A to the section of FIG. 14G. In contrast, the transition 205 of the shower base 201 is configured having a generally constant height relative to the cover 210 with the varying radius decreasing in size moving from the section of FIG. 14A to the section of FIG. 14G. FIG. 14A shows a relative difference in height A between the transition 205 and the transition 105, when cut by a vertical plane.

FIG. 15A illustrates a section cut that is farthest from the transition of the shower base, and each successive section (e.g., 15B, 15C, etc.) is cut closer to the transition of the shower base with FIG. 15D being cut through the transition. As shown in FIGS. 15A-15C, the floor 103 of the shower base 101 and the floor 203 of the shower base 201 have generally the same shape (e.g., profile). However, as shown in FIG. 15D, the transition 105 of the shower base 101 slopes downwardly from the side wall toward the mid-point or mid-plane and, therefore, has a higher relative height at the wall than at the mid-plane of the base. Also shown in FIG. 15D, in contrast to the transition 105 of the shower base 101, the profile of the transition 205 of the shower base 201 is configured generally flat from the side wall to the vertex 250 and, therefore, does not have a sloping configuration.

Figure 16:
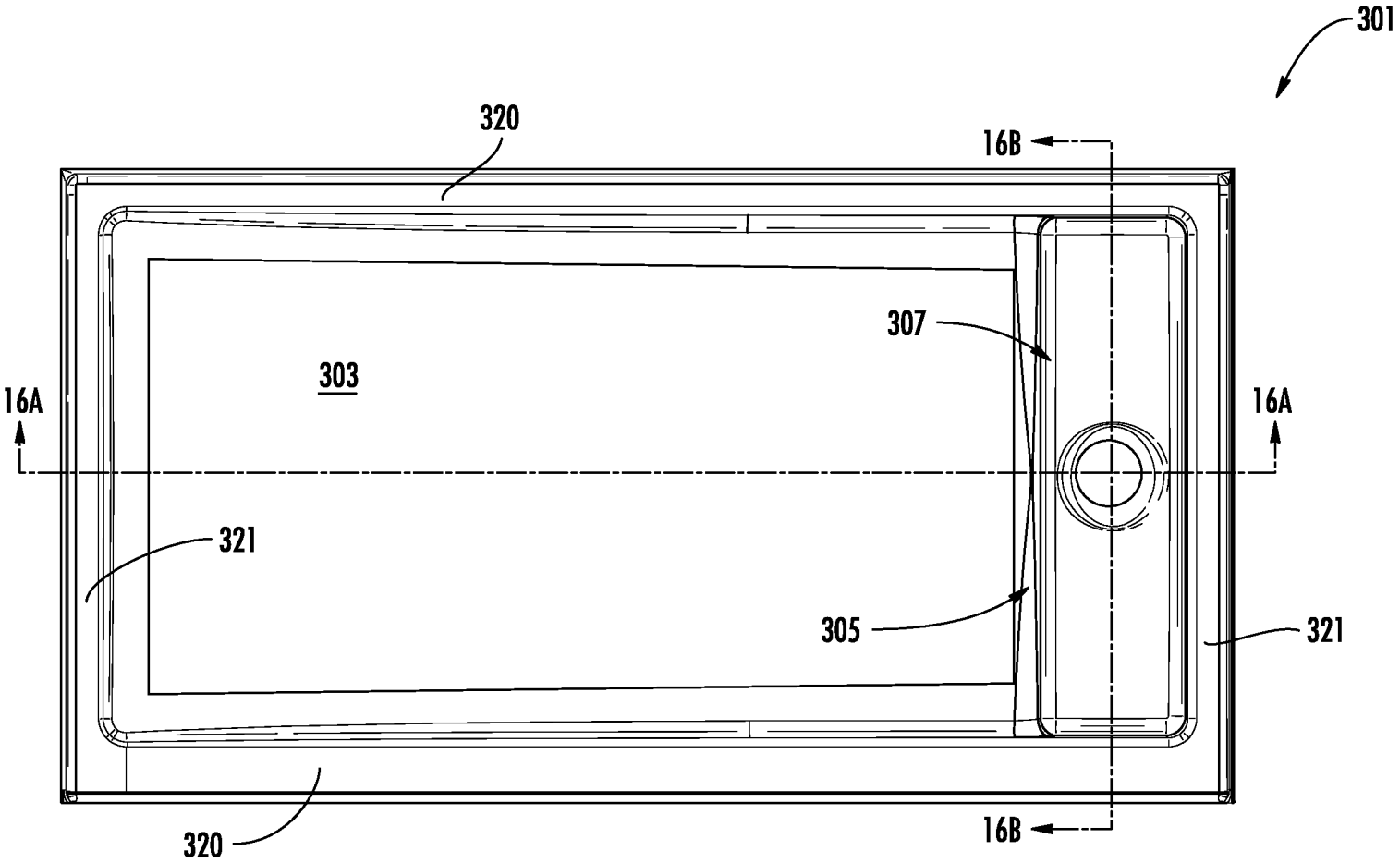
FIG. 16 is a top view of another exemplary embodiment of a shower base.
Figure 16A:
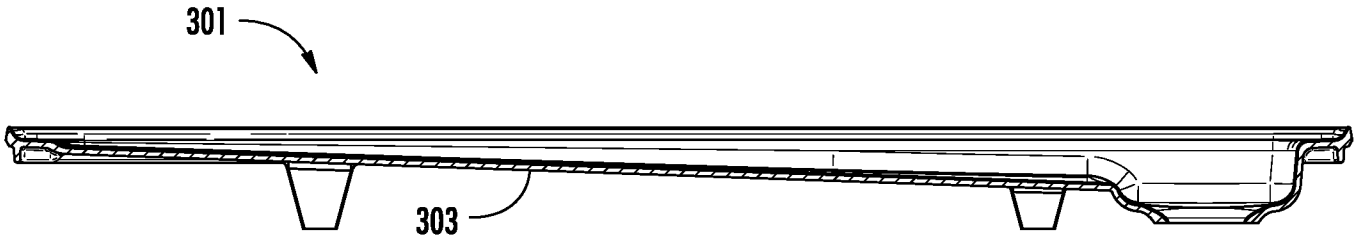
FIG. 16A is a cross-sectional view of the shower base of FIG. 16 taken along line 16A-16A.
Figure 16B:
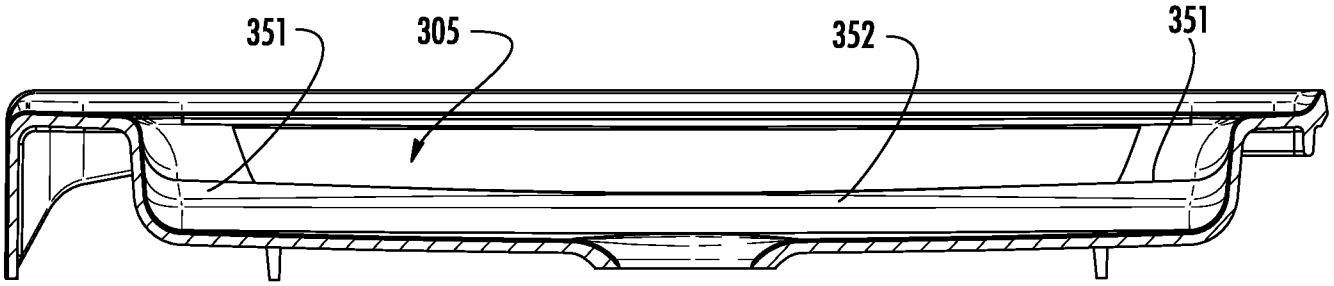
FIG. 16B is a cross-sectional view of the shower base of FIG. 16 taken along line 16B-16B.
Figure 16C:
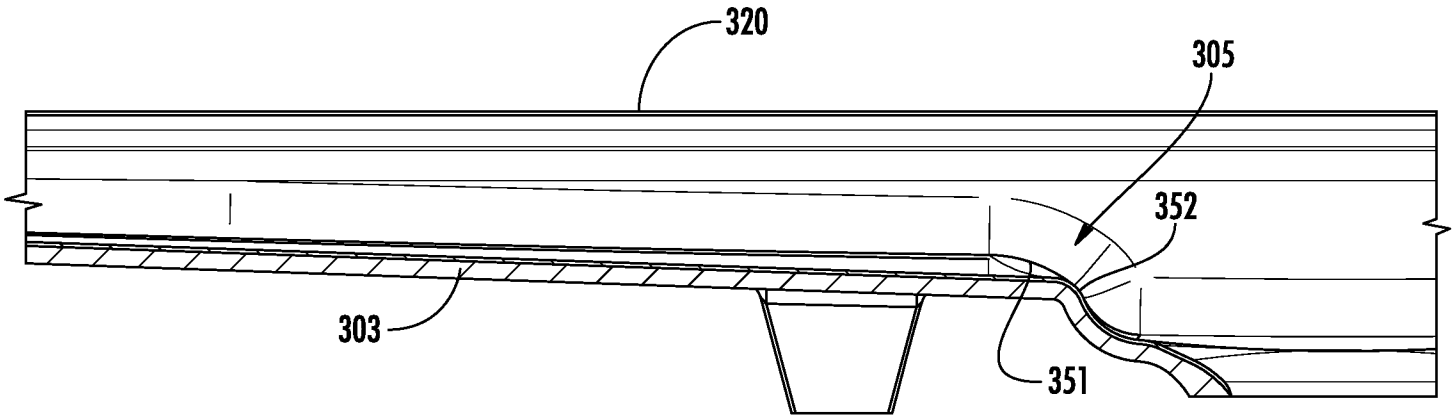
FIG. 16C is a detail view of the shower base of FIG. 16A.

FIGS. 16-16C illustrate an exemplary embodiment of a shower base 301. It is noted that any specific dimensions provided for the features of the shower base 301 (or any other examples disclosed herein) are intended to provide an example and are not limiting. For example, although the width of the shower base 301 is shown to be 812.8 mm (32.0 inches), the width may be different than provided, such as being 863.6 mm (34.0 inches). Also, according to one example, the length of the shower base 301 is 1524 mm (60 inches). Also, according to one example, the length of drain opening from an end of the shower base 301 is 165.1 mm (6.5 inches). It is also noted that the features or elements of the shower base 301 labeled with the same last two digits as the shower base 201, but with a three for the first digit, may correspond to and be configured substantially the same as the corresponding feature or element of the shower base 201. However, the feature or element of the shower base 301 may be configured differently than the corresponding feature or element of the shower base 201.

As shown, the shower base 301 includes two opposing sides 320, two opposing ends 321, a floor 303 connected to the two sides 320 and to one end 321, a recessed drain cavity 307 (e.g., drain pocket) connected to the other end 321, and a transition 305 extending between the floor 303 and the drain cavity 307. The transition 305 includes first and second sections 351 extending in opposite directions from the vertex 350 to the sides 320. Each section 351 includes a compound radius, such as having a radius that varies in size (e.g., increases) moving from the vertex 350 to the respective side 320. The transition 305 also includes a third section 352 having a constant radius that extends from the bottom portion (e.g., edges) of each of the first and second sections 351. The constant radius third section 352 is connected to the drain cavity 307, such as an upper portion (e.g., edge) of the recessed pocket below the floor 303.

Figure 17:
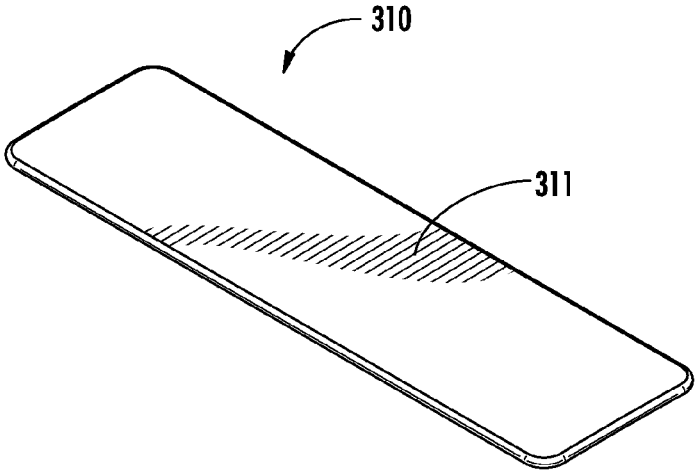
FIG. 17 is a top perspective view of an exemplary embodiment of a cover for use with a shower base.
Figure 18:
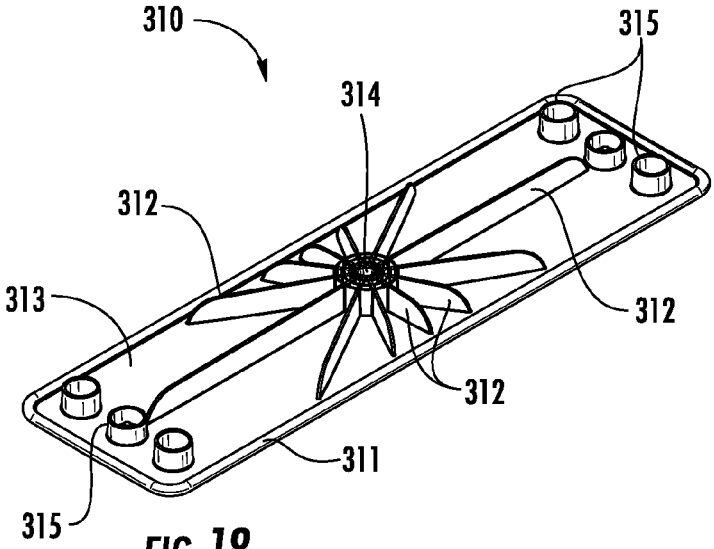
FIG. 18 is a bottom perspective view of an exemplary embodiment of a cover, such as the cover of FIG. 17.

FIGS. 17 and 18 illustrate an exemplary embodiment of a cover 310 that is configured to engage the drain cavity 307 of the shower base 301. As shown, the cover 310 includes a base 311 and at least one rib 312 (e.g., protrusion) extending from an underside 313 (e.g., bottom) of the base 311. The base 311 may be generally rectangular in shape with a relatively small thickness, or may have any suitable shape that is configured to complement the shape of the drain pocket or cavity. As shown in FIG. 18, the cover 310 includes a plurality of ribs 312 extending away from the underside 313 of the base 311, where the ribs 312 have a radial alignment from a central post 314. For example, the central post 314 and/or the ribs 312 may be configured to engage the drain opening and or the drain pocket to help secure the cover 310 to the shower base 301. The cover 310 may also include additional members 315 extending away from the underside 313 of the base 311, such as to contact a top surface of the bottom of the drain cavity 307 in order to support the cover 310 engaging the drain pocket of the shower base 301.

Figure 19:
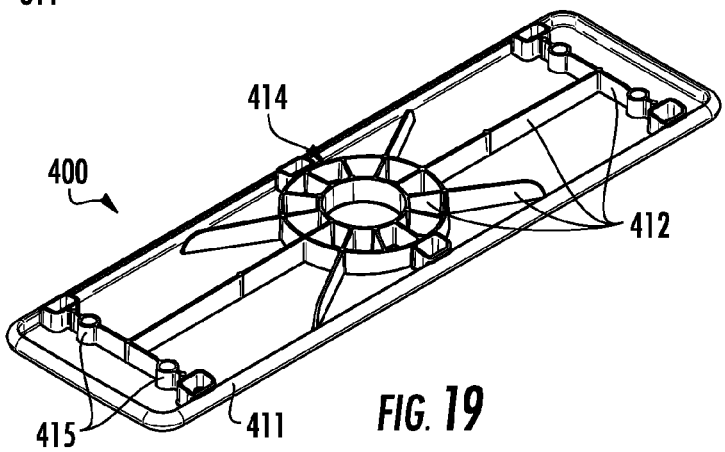
FIG. 19 is a bottom view of another exemplary embodiment of a cover, such as the cover of FIG. 17.

It is noted that the cover may be configured differently than the cover 310 of FIGS. 17 and 18. For example, the size and/or geometry of the cover may be changed. One such example is shown in FIG. 19, in which the cover 410 includes a base 411 and at least one rib 412 extending from an underside of the base 411. The base 411 may have any suitable shape that is configured to complement the shape of the drain pocket or cavity. As shown, the cover 410 includes a plurality of ribs 412 extending away from a central post 414 in a radial direction, and also includes additional ribs 412 outer cylindrical members 415. The ribs and additional members may help improve strength and/or improve cleanability of the cover, as well as facilitate the detachable connecting of the cover 410 to a shower base, such as its drain cavity.

The shower bases, as discussed herein, including, for example, transitions with a variable sized portion or section (e.g., conical portions) and a constant sized (e.g., radius) portion or section may advantageously increase the strength of the shower base to reduce the tendency of the shower base to distort or deform, such as during forming or enameling. The increased strength reduces the amount of sag, such as in the floor, which eliminates or greatly reduces the likelihood that pockets will form along the floor. For example, the transitions having both sections of variable size and constant size are configured to increase the strength to resist bending through the transition to better support the floor of the shower base.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the shower receptors and systems as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention. For example, any element that has been shown or described in one embodiment may be utilized with any other embodiment disclosed.

What is claimed is:

1. A shower base for a shower assembly, comprising:

a floor having an end and at least one side;

a drain cavity disposed at the end, wherein the drain cavity is recessed downwardly relative to the floor to capture water therein; and a transition connecting the end of the floor to a portion of the drain cavity, the transition comprising a first section having a compound radius that varies in size along the first section, wherein the first section extends outwardly from a vertex to the at least one side of the floor;

wherein an edge of the first section of the transition is collinear with a forward edge of the end of the floor.

2. The shower base of claim 1, wherein the compound radius of the first section has an increasing size moving from the vertex to the side of the floor.

3. The shower base of claim 2, wherein the first section has a semi-conical shape with linear edges.

4. The shower base of claim 2, wherein the transition further comprises a second section interconnecting the portion of the drain cavity and the first section of the transition, wherein the second section has a constant radius.

5. The shower base of claim 1, wherein the transition further comprises a second section having a compound radius that varies in size along the second section, and wherein the second section extends outwardly from the vertex to a second side of the floor.

6. The shower base of claim 5, wherein the second side of the floor opposes the first side of the floor, such that the first and second sections extend from the vertex in opposite directions.

7. The shower base of claim 6, wherein the compound radius of the first section has an increasing size moving from the vertex to the first side of the floor, and wherein the compound radius of the second section has an increasing size moving from the vertex to the second side of the floor.

8. The shower base of claim 7, wherein the vertex is located at an equal distance from both the first and second side walls, and wherein the size of the compound radius of the first section increases at a rate that is the same as a rate that the second section increases moving from the vertex to the respective side of the floor.

9. The shower base of claim 7, further comprising a third section interconnecting the portion of the drain cavity to the first and second sections of the transition, wherein the third section has a constant radius and extends between the first and second sides.

10. A shower assembly, comprising:

a shower base comprising;

a floor;

a drain cavity disposed at a forward edge of the floor and recessed downwardly relative to the floor to capture water therein; and a transition extending between the forward edge of the floor and an edge of the drain cavity, wherein the transition includes a first section having a linearly increasing compound radius extending outwardly in a side to side direction from a vertex to a side of the floor; and a drain cover configured to removably engage the shower base to conceal the drain cavity, wherein the drain cover includes a side that is proximate to the transition;

wherein a gap between the side of the drain cover and the first section of the transition has an appearance of having a constant size along a length of the first section.

11. The shower assembly of claim 10, wherein a coincident edge between the first section and the forward edge of the floor has a pitch angle relative to the second side of the floor.

12. The shower assembly of claim 10, wherein the transition further includes a second section having a compound radius and extending outwardly from the vertex to a third side of the floor that opposes the second side of the floor.

13. The shower assembly of claim 12, wherein a gap between the side of the drain cover and the second section of the transition has a constant size along a length of the second section.

14. The shower assembly of claim 13, wherein the size of each gap is constant along an entire length of the first and second sections.

15. The shower assembly of claim 12, wherein the compound radius of the second section has an increasing size moving from the vertex to the third side of the floor.

16. The shower assembly of claim 12, wherein a coincident edge between the first section and a first portion of the forward edge of the floor has a pitch angle relative to the second side of the floor, and wherein a coincident edge between the second section and a second portion of the forward edge of the floor has a pitch angle relative to the third side of the floor.

17. The shower assembly of claim 16, wherein the transition further includes a third section that extends transversely between the second and third sides of the floor, wherein the third section interconnects the portion of the drain cavity and the first and second sections of the transition, wherein a coincident edge between the first and third sections has a pitch angle relative to the second side of the floor, and wherein a coincident edge between the second and third sections has a pitch angle relative to the third side of the floor.

18. The shower assembly of claim 17, wherein each pitch angle is between zero (0) and ten (10) degrees.

19. A shower assembly, comprising:

a floor including a generally conical section;

a downwardly recessed drain cavity disposed at a first side of the section of the floor;

a first transition interconnecting a first portion of the drain cavity and a first portion of the first side of the section of the floor, the first transition having a compound radius and extending laterally outward in a first direction from a vertex to a second side of the floor; and a second transition interconnecting a second portion of the drain cavity and a second portion of the first side of the section of the floor, the second transition having a compound radius and extending laterally outward in a second direction opposite the first direction from the vertex to a third side of the floor;

wherein the first transition has an increasing size moving from the vertex to the second side of the floor and the second transition has an increasing size moving from the vertex to the third side of the floor.

20. The shower assembly of claim 19, wherein a center of the conical section of the floor is approximately concentric with a center of a drain opening in the drain cavity.

21. The shower assembly of claim 20, wherein the vertex is offset from a center of the conical section of the floor, such that a vertical plane formed through the center of the conical section and the vertex is at an oblique angle to one of the second and third sides of the floor.

* * * * *